United States Patent [19]

Michael

[11] 4,155,851

[45] May 22, 1979

[54] VACUUM DRAINAGE SYSTEM

[75] Inventor: Harald R. Michael, Hamburg, Fed. Rep. of Germany

[73] Assignee: Electrolux GmbH, Fed. Rep. of Germany

[21] Appl. No.: 826,669

[22] Filed: Aug. 22, 1977

[30] Foreign Application Priority Data

Aug. 24, 1976 [DE] Fed. Rep. of Germany ..... 2637962

[51] Int. Cl.[2] ..... C02C 1/00; E03D 1/00

[52] U.S. Cl. ..... 210/105; 210/170; 210/220; 137/236 R

[58] Field of Search ..... 4/345, DIG. 9; 137/205, 137/236; 210/15, 63 R, 170, 220, 101, 105

[56] References Cited

U.S. PATENT DOCUMENTS

| | | | |
|---|---|---|---|
| Re. 28,189 | 10/1974 | Liljendahl | 137/205 X |
| 3,115,148 | 12/1963 | Liljendahl | 137/205 |
| 3,229,707 | 1/1966 | Suchan | 137/236 |
| 3,239,849 | 3/1966 | Liljendahl | 4/345 |
| 3,525,685 | 8/1970 | Edwards | 210/170 X |
| 3,730,884 | 5/1973 | Burns et al. | 210/170 X |
| 3,788,338 | 1/1974 | Burns | 137/205 X |
| 3,807,431 | 4/1974 | Svanteson | 137/205 |
| 3,959,142 | 5/1976 | Dupre | 210/170 |

*Primary Examiner*—Robert H. Spitzer
*Attorney, Agent, or Firm*—Larson, Taylor & Hinds

[57] ABSTRACT

A vacuum drain system including a collecting tank and a sewage drain vacuum conduit line for conveying sewage from service connections to the collecting tank under the influence of vacuum in the system. Each service connection for admitting sewage includes a suction valve which also admits a volume of air to facilitate movement of sewage in the system. In order to prevent accumulation of sewage during prolonged periods of low usage of the system, such as at night, an auxiliary aeration system is provided for introducing a volume of air independently of the air admitted through operation of the suction valves.

11 Claims, 1 Drawing Figure

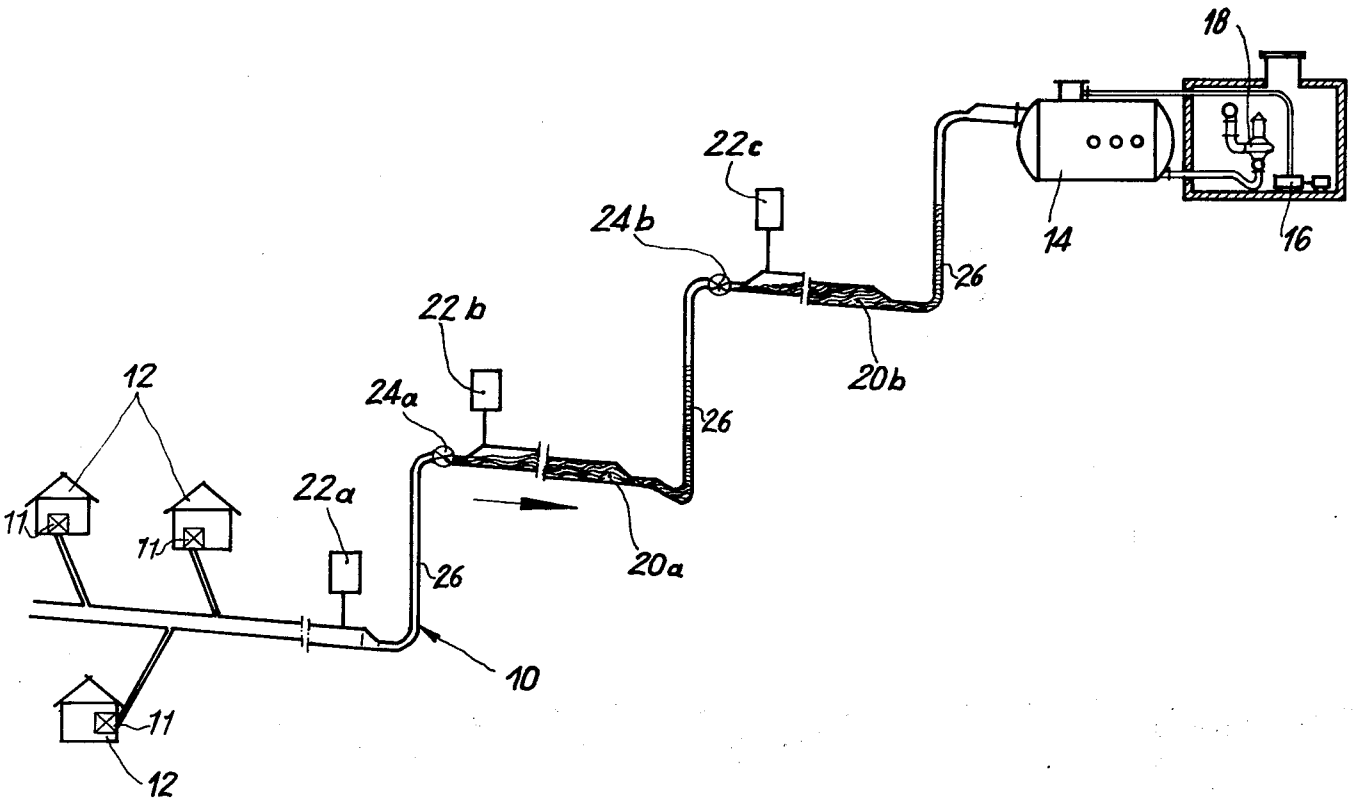
18
16
14
26
20b
22c
24b
26
20a
22b
24a
26
10
22a
12
11
11
11
12

VACUUM DRAINAGE SYSTEM

The invention relates to a vacuum drainage system with one or more collecting tanks under vacuum and especially with rising vacuum lines for sewage. Connecting lines, under standard pressure, of the units to be drained, are connected into the system via a suction valve which opens automatically whenever a certain volume of sewage has collected in front of it. The suction valve remains open at each opening process for a length of time such that a volume of air amounting to from two to fifteen times the volume of the sewage, flows into the vacuum line with the sewage.

Such a drainage installation has been described, for example, in U.S. Pat. No. 3,239,849 and in German OS No. 2,455,551, herein incorporated by reference. The air which is led into the vacuum line during each opening of a suction valve of a service connection, will drive the sewage of this service connection and the sewage still in the line in the direction toward the collecting tank. Since, however, the air penetrates and passes through the sewage in the form of bubbles on its way to the collecting tanks, a certain volume of the sewage is not conveyed uninterruptedly to the collecting tank but by steps: first by the air which had been led in via the suction valve of the pertinent service connection itself and later by air which flows into the system through other service connections in front of (i.e. upstream) of the position of the particular volume of sewage under consideration.

In designing the known systems, one takes into account a "simultaneity factor"—a factor which is based on the fact that under normal operating conditions, several different suction valves will open simultaneously or in rapid succession in any particular system. This simultaneous actuation of the suction valves admits a relatively large quantity of air into the system which facilitates movement of the sewage through the sewage drain conduit line and into the collection tank. However, during some prolonged periods, such as at night, the suction valves are infrequently actuated and, since a lesser volume of air is admitted into the system, a fairly large volume of sewage collects in the vacuum line. It would be possible, of course, to permit more air to enter the system each time that a suction valve is opened. However, this would not be economical since it requires energy to move the additional air through the system and since a lesser volume of air is sufficient under normal conditions due to the spontaniety factor mentioned above.

The larger the amount of water or sewage in the vacuum line, the worse the operation of the entire installation because of the inherent difficulty of intermittently accelerating a large body of water. In particular, the vacuum at a location in the system remote from the collection tank may not be sufficient. Breakdowns are therefore possible since the suction valves of the service connections are operated by vacuum. In addition, malfunctions may also develop in the event that a vacuum line becomes "plugged up" with too much standing sewage. In that event, because of a slight difference in pressure, sewage flowing in from one service connection may flow in the wrong direction.

One object of the present invention is to avoid accumulations of water of the type mentioned above in a vacuum drainage installation. This and other objects which will be apparent to those of ordinary skill in the art, are achieved according to the invention by providing at least one aeration arrangement, controlled in dependence on the water level or on the pressure at a certain place in the vacuum line, via which a certain volume of air may be introduced into the vacuum line, by thrusts. The amount of air thus introduced is a multiple of the volume of air introduced during the opening of a flushing valve.

The aeration arrangement proposed according to the invention is to be compared with an auxiliary drive for sewage which had become stuck in the line in front of a rise. The volume of air allowed to enter by thrusts through the aeration arrangement must be sufficiently great in order to produce a strong pressure differential across the volume of sewage that is to be conveyed. Too large a volume of air would essentially only be sucked through the standing sewage in the form of bubbles.

A comparison of the opening times of the aeration installations and of the suction valve of a service connection illustrates the order of magnitude of the volumes of air: air will still continue to flow for about 3 to 6 seconds at the service connection after the drained off sewage; the aeration arrangement on the other hand, will open, depending on the volume of water in the line, for about 1 to 30 minutes or even longer and will be a multiple of the air admitted through a service connection. The opening time of the aeration arrangement may be set at a desired value or provision can be made so that the aeration arrangement will only be closed whenever the entire volume of sewage has been forced by the air out of the line and into the collecting tank. In the latter event, the aeration time can conveniently be terminated when a pre-determined flow rate of air entering the collection tank is detected.

In order to control the proposed aeration arrangement in a desired manner, sensing devices are disposed at suitable places along the vacuum line, which, for example, produce a control signal whenever the water level in a rising section of the line reaches a certain level, for example, about two meters above a horizontal section lying in front of it or the section laid with a gradient, or whenever the volume of water in the line there will cause a pre-determined rise in pressure. In order to operate the aeration arrangement as seldom as possible, the control preferably is equipped with a delaying arrangement which will allow the assigned aeration arrangement to open only whenever a triggering border value of the water level or pressure exists for a certain period of time, for example, 10 minutes. For the same reason, provision may be made for an aeration arrangement to be operable only after a minimum time interval of, for example, 20 minutes between each successive aeration operation.

The control of the aeration arrangement may also be effective during start-up of the vacuum system. In order to arrive at a vacuum for the system of about 0.6 atmospheres starting out from 1 atmosphere, an installation will require, for example, 15 to 20 minutes. The starting time is slightly prolonged through the aeration without there being any need as a result of it to put up in practice with any disadvantages. If desired, the opening time interval of the aeration installations can be fixed in such a way that aeration is accomplished only once during start-up.

Aeration of a sewage line connected to a vacuum station in accordance with the invention may also be used in the case of other problems, for example, in order to prevent putrefaction in a vacuum line which is functioning correctly in rest times, but which is relatively long and to which only a few houses are connected. Such a line may be completely emptied from time to time by aeration and, as a result, the residence time of the sewage in the line may be shortened.

The situation is similar whenever pressure conveying lines, the pumps for the pressure liquid of which are supported by a vacuum station, are to be emptied at certain intervals. In these cases, the control of the aeration arrangements, however, is not accomplished in dependence on the water level or the vacuum at certain places of the line, but is activated at determined time intervals.

The invention will be explained in more detail subsequently on the basis of the drawing which is a diagrammatic view of a vacuum drain installation according to the invention.

The drawing shows a vacuum line 10 for the sewage of a community. The vacuum line is normally branched several times and a large number of houses 12 are connected to it. The sewage of every house is collected in small quantities and is then sucked via a suction valve 11 into the vacuum line 10. In the case of each opening process, the suction valve of a service connection will remain open for such a length of time that not only the volume of water collected in front of it, but a certain volume of air flowing immediately after it, is also sucked into the vacuum line 10, which volume of air drives the sewage in front of itself in the direction of a collecting tank 14. Since the volume of air led in together with a certain volume of sewage of a service connection into the vacuum line 10 overtakes the pertinent volume of water on the often long path to the collecting tank, the installation altogether functions in such a way that every volume of air having reached the vacuum system via a certain service connection contributes in part to conveying to the collecting tank all of the sewage present between the service connection through which that volume of air was admitted and the collecting tank.

It is obvious that the greater the pressure differential across a given plug of water, the more effective will be the conveyance of that plug of water in the vacuum line 10. This pressure difference in turn depends on the volume of air existing behind the water plug. However, while larger volumes of air are basically better suited to transport the sewage in the vacuum line 10 toward the collecting tank 14, it would be uneconomical to allow a large quantity of air to flow in in the case of every emptying process of a service connection. One may indeed count on the fact that in the case of many connected houses and other units in the case of which sewage is obtained, several suction valves will be operated simultaneously or in quick succession during normal operations, so that a desired large volume of air will reach the vacuum line 10 and will convey the sewage present therein to the collecting tank 14. Whenever a certain water level has been reached in tank 14, the sewage is sucked off by another pump 18 counter to the vacuum in the collecting tank 14 which vacuum is produced by pump 16.

During extended rest periods and during an individual opening of the suction valves on the service connections, only small quantities of air will reach vacuum line 10, since under these conditions, one may not count on the above-mentioned simultaneity factor. The individual small quantities of air allowed in, will not produce a sufficient pressure differential to move a large accumulation of water in vacuum line 10. The air is simply sucked through the water only in the form of bubbles and the vacuum line 10 will become filled with more sewage at every emptying process of a service connection.

As shown in the drawing, the accumulations of water in the vacuum line 10 designated by **20*a* and 20*b*, form especially in and in front of rising sections 26 of the line 10. The height of the water column in the rising sections of the line is a measure of the pressure differential in the line across a pertinent water accumulation 20*a* or 20*b***. A high water column indicates that behind the pertinent accumulation of water, there still only is a relatively weak vacuum in the vacuum line.

In order to be able to operate economically the vacuum drainage installation under normal operating conditions, i.e., in case of every opening process of the suction valve of a service connection to allow only the smallest possible volume of air to flow in, and on the other hand, to prevent during prolonged rest periods to much sewage to collect in the vacuum line and that thereby said vacuum line becomes incapable of functioning, one or several aeration arrangements **22*a, b, c,*** have been provided according to the invention which allow a larger volume of air to enter into the vacuum line. Preferably, each aeration system is operated automatically under the influence of a control dependent on the water level or on the pressure at a certain location along the vacuum line. The location is preferably in a rising section of the line and the volume of air admitted is dimensioned according to the pipe or water volumes in such a way, that it will be sufficient for producing a sufficiently large pressure differential in the vacuum line in order to start the water standing therein to move and to convey it at least over the next rise in the line.

In one embodiment, the control of the aeration arrangement **22*a, b, c,*** includes means for detecting water level or water pressure as a function of time such that aeration is actuated only whenever the triggering water level or water pressure border value has existed for a pre-determined period of time of, for example, 10 minutes. In addition, the control may be provided with timer means permitting repeated aeration only after a minimum time interval of, for example, 5 to 20 minutes.

By the present aeration arrangement, one will achieve that in the case of a certain number of service connection and in the case of a certain volume of sewage occurring in peak periods, the entire vacuum drainage installation, inclusive of the vacuum suction pump, may be designed economically as small as possible without there being any need to worry about breakdowns during rest periods in the case of too small a load.

Whenever an aeration arrangement is located in a position, for example, adjacent to the vacuum station, and the volume of the system of lines forms a considerable vacuum reservoir, it may happen that the air flowing in through the aeration arrangement will flow from there not only to the vacuum station, but also backwards which may force back the water in the line. In order to prevent this, non-return valves, check valves, etc., **24*a, b*** may be located on the line upstream of such aeration device.

What is claimed is:

1. In a vacuum drainage system comprising: a collecting tank, a sewage drain conduit in fluid communication with said collecting tank; means for inducing a vacuum in said collecting tank to effect a flow of sewage through said sewage drain conduit into said collecting tank; suction valve means for admitting a quantity of sewage into said sewage drain conduit; means for opening said suction valve means when a quantity of sewage has collected in front of said suction valve means to permit a volume of sewage to flow into said fluid drain conduit and for retaining said suction valve open for a length of time sufficient to permit a first volume of air, in the amount of two to fifteen times said volume of sewage, to flow into said fluid drain conduit to drive the sewage through said sewage drain conduit the improvement which comprises:

means for sensing the pressure of sewage at at least one location in said drain conduit as a function of time and for admitting, by thrusts, a further volume of air which is a multiple of said first volume of air into said sewage drain conduit in dependence upon the pressure of sewage at said location in said conduit independently of the first volume of air admitted into said conduit through said suction valve when the pressure of sewage sensed exceeds a predetermined value for a predetermined time interval.

2. An improved vacuum drain system according to claim 1 wherein said location of the amount of sewage in said conduit or of the pressure in said conduit is downstream of said further air admitting means.

3. An improved vacuum drain system according to claim 1 wherein said further air admitting means comprises means for admitting further air into said sewage drain conduit for a period of from one to sixty minutes.

4. An improved vacuum drain system according to claim 1 wherein said further air admitting means comprises means for admitting further air into said sewage drain conduit for a period of one to fifteen minutes.

5. An improved vacuum drain system according to claim 1 wherein said pre-determined period of time is from ten to thirty minutes.

6. An improved vacuum drain system according to claim 1 wherein said further air admission controlling means comprises means preventing actuation thereof until after the expiration of a pre-determined period of time after a previous actuation thereof.

7. An improved vacuum drain system according to claim 6 wherein said pre-determined period of time is from five to thirty minutes.

8. An improved vacuum drain system according to claim 1 wherein said further air admitting means comprises control means for periodically introducing a further volume of air sufficient to empty the conduit.

9. An improved vacuum drain system according to claim 8 further comprising means responsive to the flow rate of air entering said collecting tank for terminating the flow of further air into said conduit when a predetermined flow of air per unit time enters said collecting tank.

10. An improved vacuum drain system according to claim 1 further comprising means responsive to the flow rate of air entering said collecting tank for terminating the flow of further air into said conduit when a predetermined flow of air per unit time enters said collecting tank.

11. In a vacuum drainage system comprising: a collecting tank, a sewage drain conduit in fluid communication with said collecting tank; means for inducing a vacuum in said collecting tank to effect a flow of sewage through said sewage drain conduit into said collecting tank; suction valve means for admitting a quantity of sewage into said sewage drain conduit; means for opening said suction valve means when a quantity of sewage has collected in front of said suction valve means to permit a volume of sewage to flow into said fluid drain conduit and for retaining said suction valve open for a length of time sufficient to permit a first volume of air, in the amount of two to fifteen times said volume of sewage, to flow into said fluid drain conduit to drive the sewage through said sewage drain conduit;

the improvement which comprises:

means for sensing the amount of sewage at at least one location in said drain conduit as a function of time and for admitting, by thrusts, a further volume of air which is a multiple of said first volume of air into said sewage drain conduit in dependence upon the amount of sewage at said location in said conduit independently of the first volume of air admitted into said conduit through said suction valve when the amount of sewage sensed exceeds a predetermined value for a predetermined time interval.

* * * * *